US008584405B2

(12) United States Patent
Broden

(10) Patent No.: US 8,584,405 B2
(45) Date of Patent: Nov. 19, 2013

(54) MOBILE HOUSE

(76) Inventor: Bengt-Inge Broden, Skara (SE)

( * ) Notice: Subject to any disclaimer, the term of this patent is extended or adjusted under 35 U.S.C. 154(b) by 0 days.

(21) Appl. No.: 13/177,935

(22) Filed: Jul. 7, 2011

(65) Prior Publication Data

US 2012/0005969 A1 Jan. 12, 2012

(30) Foreign Application Priority Data

Jul. 8, 2010 (SE) ..... 1050760

(51) Int. Cl.
*E04H 1/00* (2006.01)

(52) U.S. Cl.
USPC ..... 52/79.9; 52/126.6

(58) Field of Classification Search
USPC ..... 52/79.9, 126.6, 79.1, 79.5, 79.12, 52/126.1, 126.5
See application file for complete search history.

(56) References Cited

U.S. PATENT DOCUMENTS

| | | | | |
|---|---|---|---|---|
| 3,991,252 | A * | 11/1976 | Kolakowski et al. | 52/309.9 |
| 5,950,373 | A * | 9/1999 | von Hoff et al. | 52/79.5 |
| 6,269,494 | B1 * | 8/2001 | Moretto | 4/584 |
| 7,021,010 | B2 * | 4/2006 | Smith et al. | 52/169.12 |
| 8,287,997 | B2 * | 10/2012 | Paradis et al. | 428/315.9 |
| 8,470,436 | B1 * | 6/2013 | Paradis et al. | 428/315.9 |
| 2002/0095888 | A1 * | 7/2002 | Winskye | 52/234 |
| 2002/0194796 | A1 * | 12/2002 | Kress | 52/79.1 |
| 2004/0066122 | A1 * | 4/2004 | Holmes | 312/311 |
| 2004/0194401 | A1 * | 10/2004 | Smith et al. | 52/169.12 |
| 2008/0276368 | A1 * | 11/2008 | Neidich et al. | 4/679 |
| 2009/0217600 | A1 * | 9/2009 | De Azambuja | 52/79.5 |
| 2010/0024319 | A1 * | 2/2010 | Pope | 52/79.9 |
| 2010/0146871 | A1 * | 6/2010 | Carson | 52/79.6 |
| 2011/0237362 | A1 * | 9/2011 | Yach et al. | 473/481 |
| 2012/0066985 | A1 * | 3/2012 | Bachorz et al. | 52/79.9 |

* cited by examiner

*Primary Examiner* — Mark Wendell
(74) *Attorney, Agent, or Firm* — Perkins Coie LLP

(57) ABSTRACT

The present invention relates to a mobile house comprising a sill (1) of inorganic material, at least four height-adjustable feet (2), a framework (3, 4, 5, 6) of inorganic material for walls and roofs, a plurality of floorboards (7), a plurality of wallboards (8), and a plurality of roof panels (9), the adjustable feet, in the assembled state, levelly supporting the sill at a distance from the underlying ground.

17 Claims, 3 Drawing Sheets

MOBILE HOUSE

FIELD OF THE INVENTION

The present invention relates to a mobile house which is easy to transport and can be combined with more similarly constructed mobile houses for the rapid erection of a house complex such as a field hospital.

BACKGROUND AND PRIOR ART

It is known to use tents, for example, to erect field camps having a plurality of tents as living quarters and to combine tents in order to provide field hospitals. An advantage of such tented field camps is that they are relatively simple to transport and do not need to be particularly costly. A major drawback with canvas field hospitals is, however, that if canvas is contaminated by blood, for example, the sterilization process is both time-consuming and expensive. During such a sterilization process, it is not possible to utilize the field hospital for its intended use. It is also known to use converted containers, for example, for the erection of field hospitals. An advantage of such field hospitals is that they are durable and are relatively easily sterilized. A major drawback with field hospitals made of containers is, however, that they are very costly and also bulky to transport.

BRIEF SUMMARY OF THE INVENTION

An object of the present invention is to provide a mobile house which is easy to transport and, at the same time, together with more similarly constructed mobile houses, can be rapidly combined into a house complex such as a field hospital, a school building, a dining room or a hygiene area.

The present invention is based on the insight that the above-mentioned object can be achieved by means of mobile houses having an inorganic sill on adjustable feet.

The particular characteristics of a mobile house according to the present invention emerge from Patent Claim 1.

An advantage of a mobile house configured according to the present invention is that it is easy to transport in parts which can be rapidly assembled to form a house, or combined with similarly constructed mobile houses into a house body such as a field hospital.

In a preferred mobile house, a capping plate comprises a profile with channel to act as a gutter in which rainwater can be collected.

A plurality of mobile houses can advantageously be combined into a house complex, such as a field hospital, comprising at least two mobile houses according to the present invention.

The life of a mobile house according to the present invention is at least 20 years, which is considerably more than the life of currently used tents, which last for about 1 year.

Further characteristics and advantages of the present invention will emerge from the following description and subsequent patent claims.

The invention will be described in greater detail below with reference to the detailed description of embodiments and the accompanying figures, which are purely illustrative and thus are not limiting for the present invention.

DETAILED DESCRIPTION OF EMBODIMENTS

Figure 1:
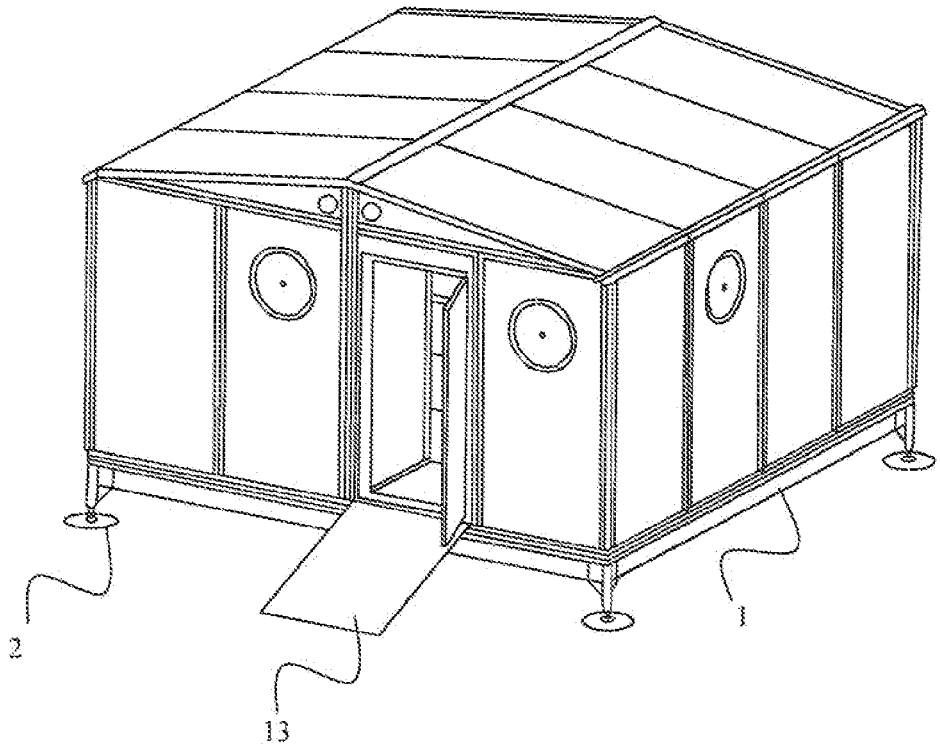
FIG. 1 shows in perspective view from above an embodiment of a mobile house according to the present invention.

In the following description, specific details, such as particular techniques and applications, are given for illustrative and non-limiting purposes in order to provide a thorough understanding of the present invention. However, it will be evident to a person skilled in the art that the present invention can be realized in other embodiments which differ from these specific details. In other examples, a detailed description of well-known methods and devices is omitted so as not to obfuscate the description of the present invention with unnecessary details.

An embodiment of a mobile house according to the present invention will be described with reference to FIGS. 1-6.

The mobile house comprises a sill 1 of inorganic material, at least four height-adjustable feet 2, a framework 3, 4, 5, 6 of inorganic material for walls and roofs, a plurality of floorboards 7, a plurality of wallboards 8, and a plurality of roof panels 9, wherein, in the assembled state, the adjustable feet levelly support the sill at a distance from the underlying ground.

The mobile house is normally rectangular and the adjustable feet are advantageously placed in respective corners of the thus rectangular sill.

The fact that the mobile house rises up at a distance from the underlying ground yields a number of advantages. Any rainwater or other flowing water is not at risk of entering the house. Such water can be heavily contaminated many times over in various types of camps in which there is poor hygiene management, and thus contributes to a heavily deficient standard.

The sill 1 is advantageously made of metal, preferably galvanized steel plate. The framework is advantageously made of inorganic material, preferably impact-resistant ABS or equivalent plastics material. The fact that the framework is made of impact-resistant ABS or equivalent plastics material produces a practicable and usable inner side which is easy to disinfect and clean, whereby the spread of transmissible diseases amongst the inhabitants is largely reduced.

The mobile house advantageously comprises fire protection 10 under the floorboards 7 and is supported by the said sill. The fire protection is preferably made of corrugated plate.

The floorboards 7 are advantageously constructed with an upper layer of impact-resistant ABS or equivalent plastics material, or magnesium-oxide-based plasterboard and stone board, and a lower layer of foamed plastic, preferably a density of 200. The floorboards can preferably have the dimension 2400×1200×48.

The framework 3 advantageously comprises at floor level a horizontal open profile for the reception of floorboards. The framework 4 advantageously comprises in walls a horizontally open profile for the reception of wallboards. In addition, the framework 6 advantageously comprises in the roof a capping having a horizontally open profile for the reception of wallboards and a profile open towards the ridge for the reception of roof panels. In addition, the framework 5 advantageously comprises a profile open towards the capping for the reception of roof panels.

Preferably, the capping further comprises a channel 11 directed outwards from the mobile house for the catching and collection of rainwater. Rainwater which has thus been collected can advantageously be led through a filter in order to be purified by for example . . . , so as then to be usable as high-quality drinking water.

The sill advantageously comprises a profile 12 for the reception of horizontal-position-determining members, such as a ball or water. This allows simple correlation between level surveying of the mobile house and adjustment of the adjustable feet. Following adjustment, the adjustable feet are preferably locked by locknuts suitable for the purpose.

The wallboards and roof panels are advantageously realized with an inner layer of impact-resistant ABS or equivalent plastics material, an outer layer of magnesium-oxide-based plasterboard and stone board and an intervening layer of foamed plastic, preferably a density of 100. The wallboards and roof panels can preferably have the dimension 2400×1200×48. Alternatively, the wallboards and roof panels have an inner and outer layer of magnesium-oxide-based plasterboard and stone board, or impact-resistant ABS or equivalent plastics material as inner and outer layers.

By advantageously covering, preferably coating, wallboards and roof panels on the outside with a ceramic optional colour combination with heat-repellent effect, preferably microsilicate: M-DFO1, a reflection of about 84% of sunlight is achieved according to DIN 67 507.

Magnesium-oxide-based plasterboards and stone boards have the advantage of being totally non-combustible.

A mobile house having a base area of 19 $m^2$, a height of 2.4 m, and preferably comprising an internal partition wall, accommodates 6 persons according to the UNHCR's recommended standard. The mobile house can easily be equipped with solar cells for electrical energy and necessary applications for the recovery and purification of rainwater into drinking water.

Advantageously, all parts of the mobile house are made of inorganic material, so that the mobile house can be shipped freely across national borders. The adjustable feet are advantageously made of metal, preferably galvanized steel plate.

In order to facilitate entry into/exit from the mobile house, which is raised above the ground with the aid of the height-adjustable feet, the mobile house preferably comprises a ramp 13, advantageously made of metal, preferably galvanized steel plate, in order to facilitate entry and exit of wheelchair-bound persons, etc.

Figure 7:
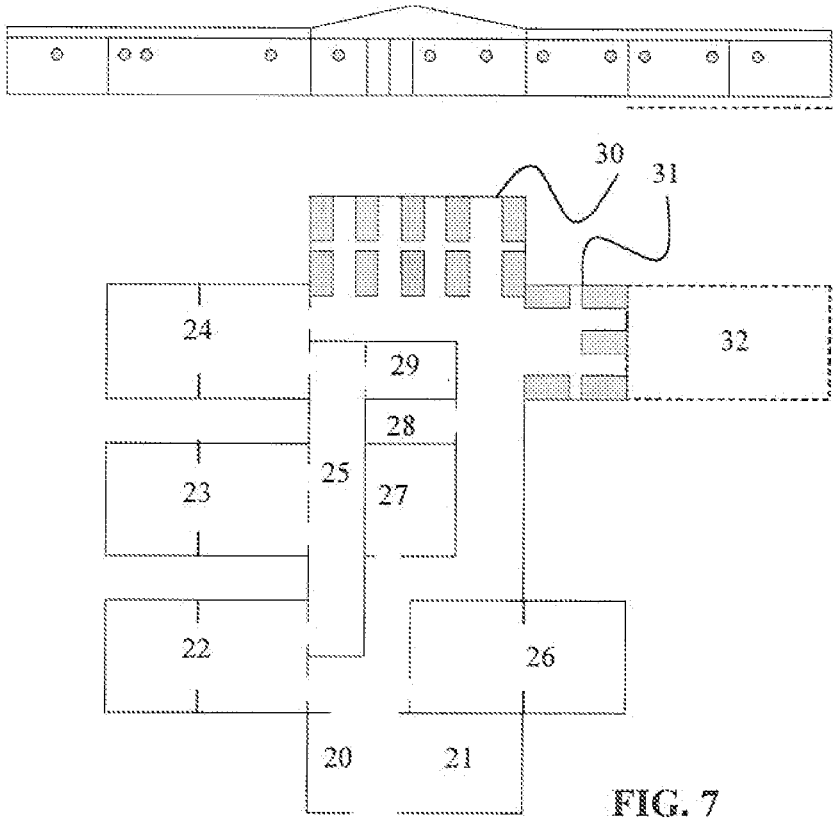
FIG. 7 shows in plan view and side view a plurality of mobile houses fitted together to form a field hospital.
Figure 6:
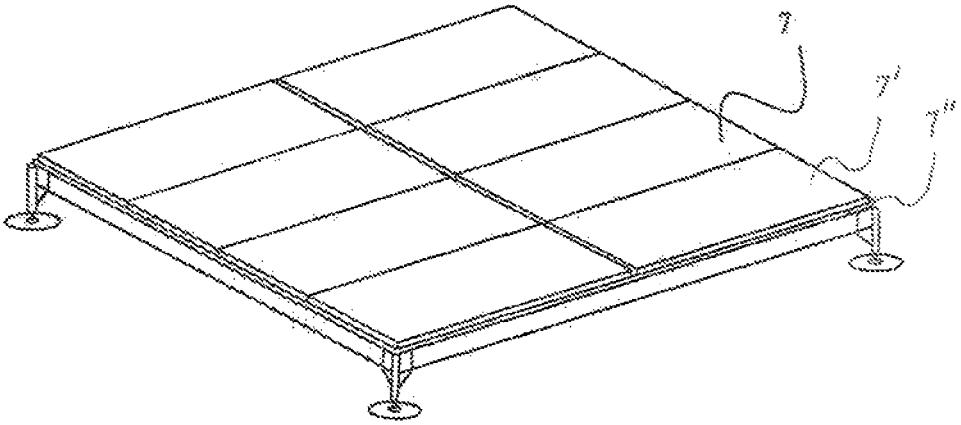
FIG. 6 shows floorboards in the mobile house shown in FIG. 1.
Figure 2:
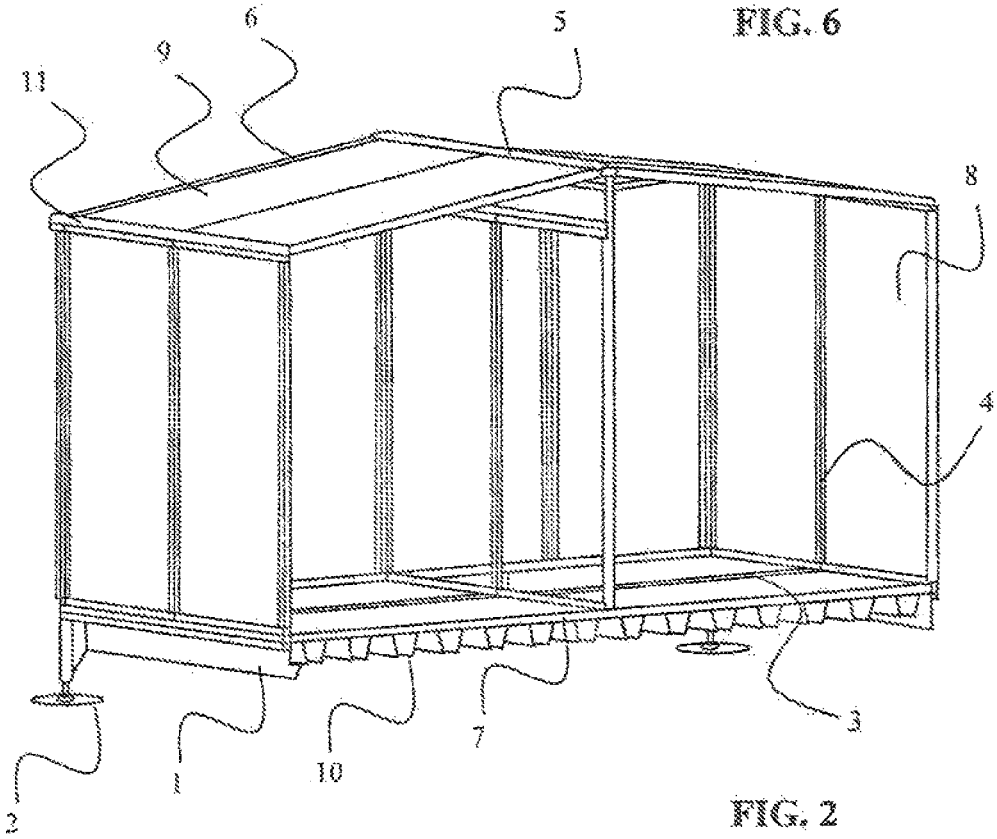
FIG. 2 shows a cross section of the mobile house shown in FIG. 1.
Figure 4:
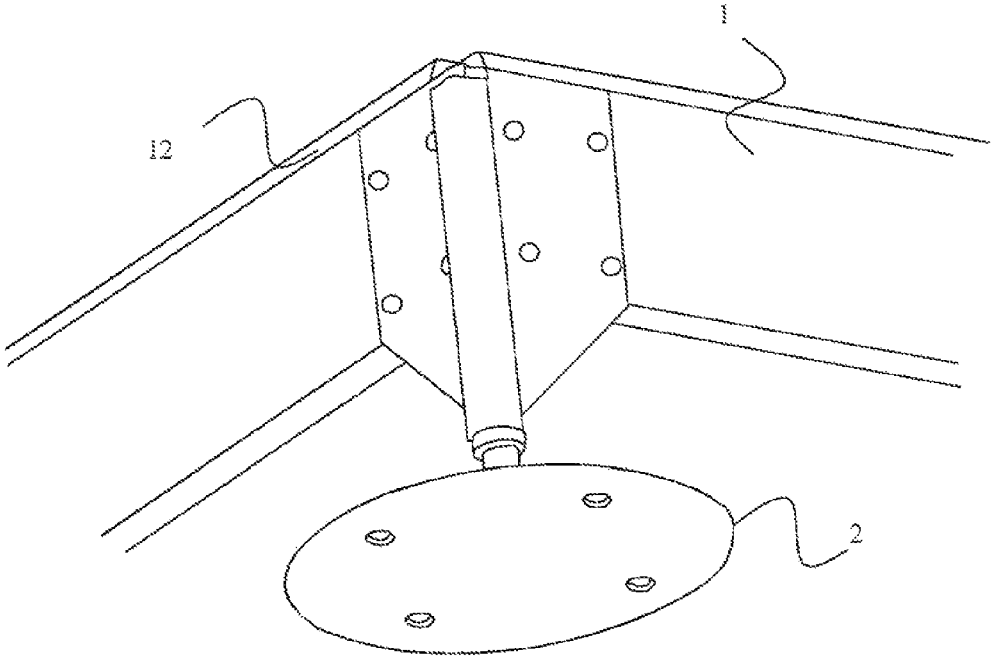
FIG. 4 shows a part of FIG. 2 in enlarged representation.
Figure 3:
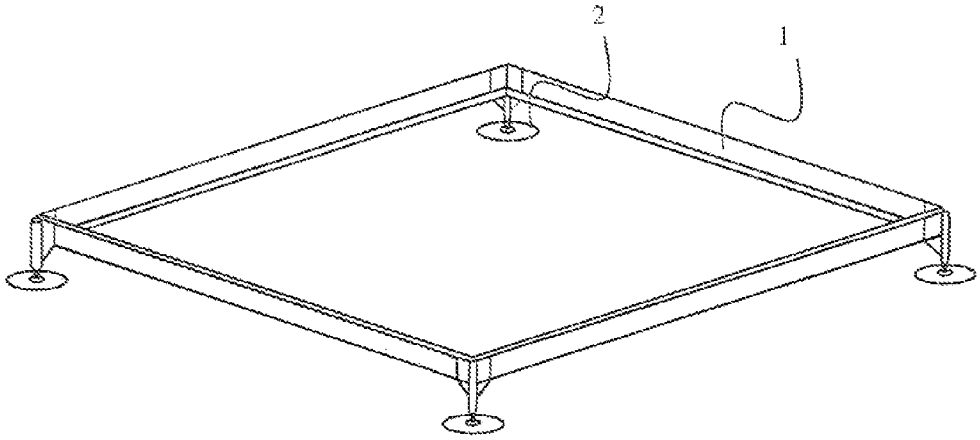
FIG. 3 shows a sill on feet, forming part of the mobile house shown in FIG. 1.
Figure 5:
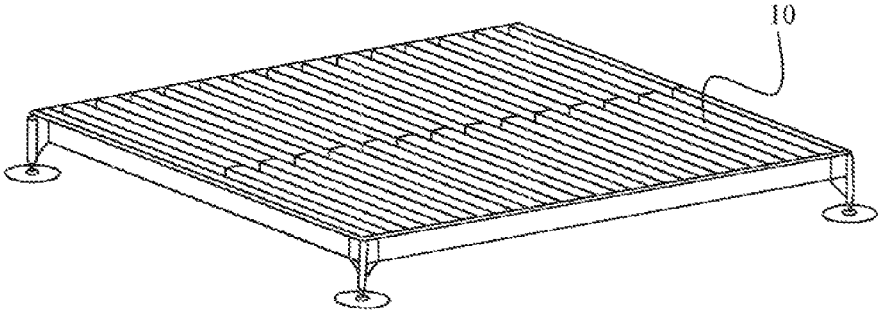
FIG. 5 shows the bottommost course of the mobile house shown in FIG. 1.

A house complex comprising a plurality of above-described mobile houses according to the present invention will be described with reference to FIG. 7.

By fitting together preferably 20 mobile houses, it is possible to obtain, for example, a field hospital. The mobile houses are held together by U-shaped elements lowered over adjacent sills. The field hospital can comprise, for example, reception 20, waiting room 21, pre-op 22, op 23, post-op 24, lock chamber 25, X-ray department 26, laboratory 27, rinsing and dishwashing area 28, sterile centre 29, nursing ward 30 for ten patients, and nursing ward 31 for five patients. The field hospital can advantageously be supplemented by a mortuary 32.

A house complex comprising 20 mobile houses with additional material for electrical, air-conditioning and dry-air installations, connectable to existing and currently known applications in which basic lighting is installed and is preferably driven by solar cells with LED lamps, is housed in a so-called 40 foot container, alternatively two 20 foot containers for air freight, and with a total weight of about 15 tonnes.

With the floorboards constructed with an upper layer of impact-resistant ABS or equivalent plastics material, a very easily disinfected and cleanable floor surface is obtained.

It is evident that the present invention can be varied in a number of ways. Such variations should not be regarded as deviation from the scope of the present invention. All such variations which are evident to a person skilled in the art are meant to be included within the scope of the present invention according to the attached patent claims.

The invention claimed is:

1. Mobile house, comprising:

a sill of inorganic material, at least four height-adjustable feet, a framework of inorganic material for wallboards and roof panels, a plurality of floorboards, the plurality of floorboards comprising an upper layer and a lower layer wherein the upper layer is selected from a group of materials consisting of: impact-resistant ABS, or magnesium-oxide-based plasterboard and stone board, and wherein the lower layer comprises foamed plastic having a density of at least 100 $kg/m^3$, a plurality of wallboards sized to fit in the framework for wallboards, and a plurality of roof panels sized to fit in the framework for roof panels, wherein, when the mobile house is in the assembled state, the adjustable feet levelly support the sill at a distance from the underlying ground.

2. Mobile house according to claim 1, wherein the sill is made of metal.

3. Mobile house according to claim 2, wherein the metal is galvanized steel plate.

4. Mobile house according to claim 1, wherein the said framework is made of inorganic material.

5. Mobile house according to claim 4, wherein the inorganic material is impact-resistant ABS.

6. Mobile house according to claim 1, comprising fire protection under the floorboards, supported by the said sill.

7. Mobile house according to claim 6, wherein the fire protection is corrugated plate.

8. Mobile house according to claim 1, wherein the framework comprises a horizontal open profile for the reception of the plurality of floorboards.

9. Mobile house according to claim 1, wherein the framework comprises a horizontally open profile for the reception of the plurality of wallboards.

10. Mobile house according to claim 1, wherein the framework comprises a capping with horizontally open profile for the reception of the plurality of wallboards and a profile open towards a ridge for the reception of the plurality of roof panels.

11. Mobile house according to claim 10, wherein the capping further comprises a channel directed outwards from an interior of the mobile house, whereby the channel catches catching of rainwater.

12. Mobile house according to claim 1, wherein the sill comprises a profile for the reception of horizontal-position-determining members.

13. Mobile house according to claim 12, wherein the horizontal-position-determining members are selected from a group of members consisting of: ball, water, or ball and water.

14. Mobile house according to claim 1, wherein the wallboards and roof panels are lined with a ceramic having a color combination with heat-repellent effect.

15. The mobile house of claim 1, wherein the lower layer of the plurality of floorboards comprises foamed plastic having a density of between approximately 100 $kg/m^3$ and 300 $kg/m^3$.

16. The mobile house of claim 1, wherein the lower layer of the plurality of floorboards comprises foamed plastic having a density of approximately 200 $kg/m^3$.

17. Mobile house complex comprising:

a plurality of mobile houses, wherein each of the plurality of mobile houses comprise a sill of inorganic material, at least four height-adjustable feet, a framework of inorganic material for wallboards and roof panels, a plurality of floorboards, the plurality of floorboards comprising an upper layer and a lower layer wherein the upper layer is selected from a group of materials consisting of: impact-resistant ABS, or magnesium-oxide-based plasterboard and stone board, and wherein the lower layer comprises foamed plastic having a density of at least 100 $kg/m^3$, a plurality of wallboards sized to fit in the framework for wallboards, and a plurality of roof panels sized to fit in the framework for the roof panels, wherein, when the mobile house is in the assembled state, the adjustable feet levelly support the sill at a distance from the underlying ground, wherein the plurality of mobile houses are held together by U-shaped elements lowered over adjacent sills.

* * * * *